United States Patent [19]

Shibata

[11] Patent Number: 4,457,787

[45] Date of Patent: Jul. 3, 1984

[54] INTERNAL OXIDATION METHOD OF AG ALLOYS

[75] Inventor: Akira Shibata, Yokohama, Japan

[73] Assignee: Chugai Denki Kogyo Kabushiki-Kaisha, Tokyo, Japan

[21] Appl. No.: 420,740

[22] Filed: Sep. 21, 1982

[51] Int. Cl.[3] ..... C22F 1/14

[52] U.S. Cl. ..... 148/13.1; 148/431

[58] Field of Search ..... 148/1.5, 13.1, 20.3, 148/431; 428/673; 420/501, 504, 506

[56] References Cited

U.S. PATENT DOCUMENTS

| | | | |
|---|---|---|---|
| 3,933,485 | 1/1976 | Shibata | 148/431 |
| 3,933,486 | 1/1976 | Shibata | 148/431 |
| 4,072,515 | 2/1978 | Motoyoshi et al. | 148/431 |

FOREIGN PATENT DOCUMENTS

| | | | |
|---|---|---|---|
| 13301 | 5/1970 | Japan | 420/506 |
| 33445 | 4/1981 | Japan | 420/501 |
| 116845 | 9/1981 | Japan | 148/431 |

*Primary Examiner*—L. Dewayne Rutledge
*Assistant Examiner*—Christopher W. Brody
*Attorney, Agent, or Firm*—Shlesinger, Fitzsimmons & Shlesinger

[57] ABSTRACT

Internal oxidation method of Ag alloys for electrical contact materials and the like, in which vacant lattice points or voids which form paths of oxygen and oxidation nuclei in the course of internal oxidation, are produced innumerably and on an atomic scale by having the alloys absorbed with hydrogen, helium, nitrogen, or neutron, or by having the alloys subjected to a reduction atmosphere of a decreased pressure or to vacuum, respectively prior to the internal oxidation.

In the course of internal oxidation, solute metals fill in the voids and precipitate as oxides at the innumerable oxide nuclei on an atomic scale, without diffusing about much but only to such extent that they reach most adjacent voids, and consequently without any segregation and depletion thereof.

9 Claims, No Drawings

INTERNAL OXIDATION METHOD OF AG ALLOYS

BACKGROUND OF THE INVENTION

Internal oxidized Ag alloys are well known. They are useful for various industrial applications, and particularly as electrical contacts.

While they are excellent at refractoriness and antiweldability, their other electrical and physical characteristics such as contact resistance are not entirely even throughout their depth, due to mechanisms inherent to conventional internal oxidation methods.

Conventional internal oxidation methods have solved, to a considerably large extent, to prevent metal oxides from precipitating at a difference of concentration, viz., higher concentration at outer areas and lower concentration at deeper areas. The methods have also prevented metal oxides from very excessively segregating. This is made by the addition to an alloy of an auxiliary solute metal such as In which has a comparatively high diffusion velocity (as described in Shibata U.S. Pat. No. 3,933,485). Or, this is made by the employment of an auxiliary solute metal such as Bi which precipitates at random in an alloy under a normal temperature as non-crystallites which in turn form lattice defects. These lattice defects constitute paths of oxygen and become oxide nuclei to which primary solute metal such as Sn congregates and is oxidized (as described in Shibata U.S. Pat. No. 3,933,486). Though these conventional methods can advantageously be employed for the internal oxidation of Ag alloys, it is often unavoidable, as mentioned above, to see a deplete zone of metal oxides at a deeper area of alloys.

On the other hand, although those electrical contact materials which are made by powder-metallurgically sintering or hot pressing metal oxide powders with Ag powders, are uniform in their distribution of oxides, they are inherently coarse and brittle.

BRIEF SUMMARY OF THE INVENTION

In view of the above, this invention is to provide an internal oxidation method of Ag alloys, in which lattice defects which constitute paths of oxygen and become oxide nuclei in the course of internal oxidation, are formed, prior to the internal oxidation, by having the Ag alloys absorbed with hydrogen, helium, nitrogen, or neutron to produce vacant lattice points or voids therein.

The absorption of the reduction gas by Ag alloys is effected by subjecting the alloys to a heat treatment held under a reduction gas atmosphere such as hydrogen, helium, and nitrogen. While Ag alloys thus heat-treated could either be annealed or quenched, a little better result is obtainable when they are quenched, probably because quenching can freeze lattice defects produced by vacant lattice points or voids with the absorption of the reduction gas by alloys. It is also experimentally affirmed that a trace amount, preferably of less than 1 weight % of addition to alloys of solute metals such as Cd, Zn, Sb, and In which comparatively readily sublimate, accelerates the formation of lattice defects in accordance with this invention, while vacant lattice points or voids produced thereby become a little larger. Said solute metals such as Cd have to be substantially completely sublimated from the alloys. Otherwise, their remnants will, in the course of internal oxidation, diffuse rapidly into voids, disturbing the oxidation of Sn, the primary solute metal about oxidation nuclei formed at voids.

This invention is most advantageously employable when Ag alloys contain 3–15 weight % of Sn.

The alloys may contain other solute metals such as Mg, Mn, Ti, Bi, Al, and Be, respectively at an amount of less than 1 weight %. This addition is to improve alloy structures such as having crystals more minuted and consequently having Sn evenly distributed, and making hardness and tensile strength of alloys higher, when so desired. For the information of the uniform microcrystals in the structure of internal oxidation, the element of the iron or alkali earth metal group may also be added at a trace amount of less than 0.5 weight %.

It shall be noted also that in this invention, the alloys could be one prepared from a melt or by means of sintering or hot press.

DETAILED DESCRIPTION OF THE INVENTION

EXAMPLE 1

An Ag alloy ingot of 50 mm width, 300 mm length, and 30 mm thickness was prepared by casting a melt of Ag-Sn 8 weight %-Co 0.2 weight %, which alloy can not have been successfully internal oxidized by prior internal oxidation methods.

The alloy ingot was cladded at its back with silver of 3 mm thickness, by hot press. The ingot was finally rolled to 1 mm thickness. Discal contacts of 6 mm diameter and 1 mm thickness were punched out from the rolled ingot plate.

The contacts were subjected to a heat treatment for 30 minutes under a temperature of 600°–800° C. and under a $H_2$ gas flow.

A 1st group of contacts were then annealed, while 2nd group of contacts were quenched. The contacts were checked of their conductivity (IACS) by a sigma tester. They showed a negligible IACS.

They were internal oxidized by subjecting to $O_2$ atmosphere of 10 atm. of 700° C. for 20 hours.

They were again checked of their conductivity. The 1st group of contacts had IACS 40–45, while the 2nd group of contacts 42–50. This fact that the contacts which had only a negligible conductivity, came to have a practical value of conductivity, shows that internal oxidation took effect and that Ag matrices became pure.

The contacts were observed optical-microscopically at 400 magnification of their structures.

While no discrete oxide precipitates were recognized, their structural images were evenly and at their entirety clouded or foggy. This observation indicates that as a result of the first mentioned heat treatment, vacant lattice points or voids should have been produced innumerably and at an atomic scale in the alloy, and that in the course of internal oxidation, they worked as oxide nuclei. The solute metal, that is, Sn diffused to and filled in the voids and were oxidized about the oxide nuclei.

Neither depletion nor segregation of oxides was observed. This indicates that Sn did not diffuse too far, but it diffused substantially in situ and was oxidized about most adjacently located oxide nuclei. Theoretically speaking, its diffusion distance was as little as an atomic distance to one of the nearest vacant lattice points or voids, since the voids were produced in this invention method innumerably and at an atomic scale throughout the entire alloy structure.

EXAMPLE 2

From an Ag alloy ingot plate of Ag-Sn 8 weight %-Co 0.2 weight %-Cd 0.05 weight % which was prepared similarly to Example 1, discal contacts of the dimensions same to those of Example 1 were obtained. They were subjected to a heat treatment held under a reduced atmosphere of $10^{-3}$ atm. at 400° C. for 1 hour. EDM observation after this heat treatment showed that there was no trace of Cd in the contact alloy.

Then, they were internal oxidized at the condition same to Example 1. They had then a conductivity comparable to that of the final contacts of Example 1. Optical-microscopical observation showed structural image resembling to those of Example 1 without any depletion or segregation of oxides, while the images were a little bit brighter.

For a comparison purpose, the Ag-Sn 8 weight %-Co 0.2 weight %-Cd 0.05 weight % discal contacts were subjected to internal oxidation without having been subjected to the aforementioned heat treatment. They could not be internal oxidized.

I claim:

1. Method of promoting the internal oxidation of an Ag alloy containing at least Sn of 3–15 weight % for electrical contact materials and the like, which comprises:

adding other solute metals which sublimate from the alloy in the course of the heat treatment held prior to the internal oxidation to the alloy for the production of vacant lattice points in the alloy with their sublimation from the alloy; and heat treating the alloy in the presence of a reducing gas or neutron prior to the internal oxidation of the alloy, whereby the alloy absorbs the reduction gas or neutron, thereby producing in the alloy vacant lattice points; and thereafter subjecting said alloy to heat in the presence of oxygen to effect the internal oxidation thereof, and during which oxidation step the vacant lattice points work as paths of oxygen and as oxidation nuclei about which Sn is diffused and oxidized.

2. Method as claimed in claim 1, in which the reducing gas is selected from the group consisting of hydrogen, helium, or nitrogen.

3. Method of promoting the internal oxidation of an Ag alloy containing at least Sn of 13–15 weight % for electrical contact materials and the like, which comprises:

adding to the alloy other solute metals which sublimate from the alloy under heat;

heating the alloy in a vacuum so as to sublimate said other solute metals from the alloy prior to the internal oxidation thereof, and thereby producing in the alloy vacant lattice points; and thereafter subjecting said alloy to heat in the presence of oxygen to effect the internal oxidation thereof, and during which oxidation step the vacant lattice points work as paths of oxygen and as oxidation nuclei about which Sn is diffused and oxidized.

4. Method as claimed in claim 1, in which the other solute metals further include metals selected from a group consisting of Cd, Zn, Sb, and In, their respective amount being less than 1 weight %.

5. Method as claimed in claim 3, in which the other solute metals further include metals selected from a group consisting of Cd, Zn, Sb, and In, their respective amount being less than 1 weight %.

6. Method as claimed in claim 1 or 3, in which subsequent to the heat treatment held prior to the internal oxidation, the alloy is annealed.

7. Method as claimed in claim 1 or 3, in which subsequent to the heat treatment held prior to the internal oxidation, the alloy is quenched.

8. Method as claimed in claim 1 or 3, in which the alloy contains Mg, Mn, Ti, Bi, Al, and/or Be, their respective amount being less than 1 weight %.

9. Method as claimed in claim 1 or 3, in which the alloy contains a trace amount of less than 0.5 weight % of ferrous or alkali earth metals.

* * * * *